United States Patent [19]

Moroz

[11] Patent Number: 5,038,679

[45] Date of Patent: Aug. 13, 1991

[54] DAMPENING FLUID APPLICATION SYSTEM FOR LITHOGRAPHIC PRINTING

[76] Inventor: Joseph F. Moroz, 8 Peach Farm Rd., Oxford, Conn. 06483

[21] Appl. No.: 442,548

[22] Filed: Nov. 28, 1989

[51] Int. Cl.[5] ..... B41L 25/04

[52] U.S. Cl. ..... 101/147; 101/148

[58] Field of Search ..... 101/147, 148

[56] References Cited

U.S. PATENT DOCUMENTS

| | | | |
|---|---|---|---|
| 2,853,004 | 9/1958 | Sanker | 101/148 |
| 2,868,118 | 1/1959 | Dahlgrew | 107/147 |
| 3,257,940 | 1/1966 | Strudwick | 101/148 |
| 3,411,441 | 11/1968 | Hermach et al. | 101/148 |
| 3,545,379 | 12/1970 | Norton | 101/148 |
| 4,016,811 | 4/1977 | Zavodny | 101/148 |
| 4,143,596 | 3/1979 | Ivett | 101/148 |
| 4,232,603 | 11/1980 | Suvak et al. | 101/148 |
| 4,619,198 | 10/1986 | Moll | 101/148 |
| 4,787,314 | 11/1988 | Harada et al. | 101/148 X |

FOREIGN PATENT DOCUMENTS

| | | | |
|---|---|---|---|
| 0131108 | 1/1985 | European Pat. Off. | 101/148 |

*Primary Examiner*—Clifford D. Crowder
*Assistant Examiner*—John S. Hilten

[57] ABSTRACT

A dampening fluid mist application system for lithographic printing comprises a container for the dampening fluid and a rotatable first roller having a rough surface for picking up and entrapping fluid from the container. A rotatable second roller having a brush surface contacts the first roller to transfer fluid from the surface of the first roller to bristles on the brush surface. A deflector bends and releases the bristles to eject fluid thereon and create a mist stream of the liquid. The rough surface on the second roller is employed to provide the desired amount of dampening fluid to the bristles and may be made of wire mesh or a series of spaced projections or knobs, for example. The deflector is made up of a plurality of separate blade segments whose edges contact different brush segments along the full width of the second roller. An adjustment mechanism independently moves the separate blade segments toward and away from the second roller in a coarse adjustment between bristle engaging and disengaging positions, while a fine adjustment in the bristle engaging position varies the degree of bending of the bristles between a minimum and a maximum. The dampening fluid application system is suitable for incorporation into new printing systems or retrofitting into existing printing systems to apply the dampening fluid mist stream to the region between rollers in the train of ink transfer rollers.

12 Claims, 4 Drawing Sheets

FIG. 5
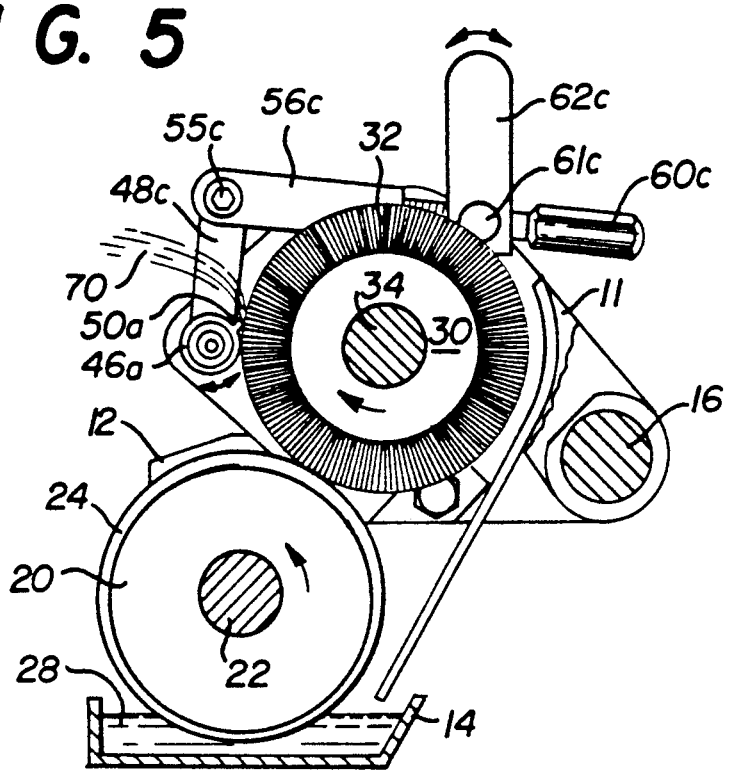
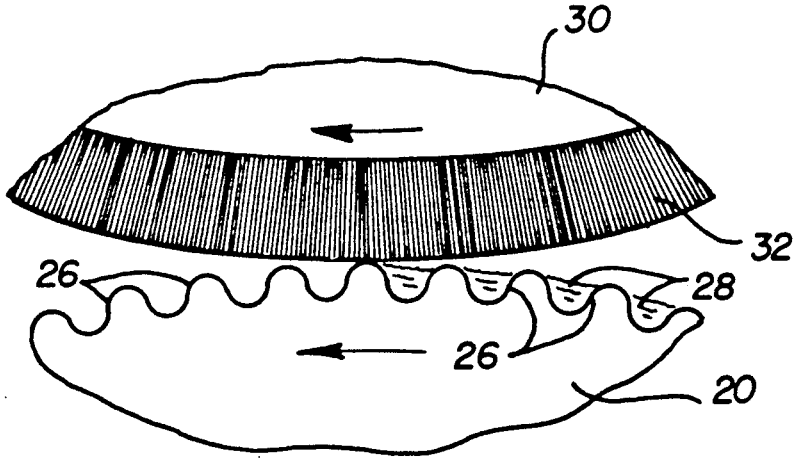
FIG. 6

DAMPENING FLUID APPLICATION SYSTEM FOR LITHOGRAPHIC PRINTING

BACKGROUND OF THE INVENTION

This invention relates to a system for applying a liquid mist and, in particular to a system for applying a mist of dampening fluid in lithographic printing.

Dampening fluids are utilized in lithographic printing to cover areas of the printing plate which are not treated by ink. These dampening fluids are generally water based liquid solutions which contain various additives and are well known in the art. The prior art discloses numerous systems for applying the dampening fluid in the form of a spray or mist to the free surface of either the printing plate or transfer rollers in the roller train which supplies the ink mixture to the printing plate. Among such systems is that disclosed in U.S. Pat. No. 4,232,603 to Suvak et al which discloses the use of a pickup roll having a loop, mesh or bristled surface partially immersed in a dampening fluid fountain. An air nozzle blows air over the surface of the pickup roll to create a mist which is directed toward a roll in the printing train.

Several U.S. patents disclose the use of brush-type rollers which pick up dampening fluid either directly from a fountain or from another roller, and which utilize deflector or "flicker" means to bend and snap the bristles to eject a fine mist of the dampening fluid. Among such systems are U.S. Pat. Nos. 2,853,004; 3,257,940; 3,545,379; 4,143,596; 4,619,198; and 4,787,314. However, systems which immerse the brush roller directly into the dampening solution or which use a smooth surfaced intermediate roll between the dampening solution and the brush roller have difficulties in controlling the mist that is generated. Other difficulties in such systems arise from the structural placement of the components of the mist application system, as well as the location on the roller drive train on which the mist is applied.

Bearing in mind the problems and deficiencies of the prior art, it is therefore an object of the present invention to provide an improved dampening fluid application system for use in lithographic printing systems.

It is another object of the present invention to provide a dampening fluid mist application system in which the mist can be more precisely controlled as to amount, drop size and direction.

It is a further object of the present invention to provide a dampening fluid mist application system in which the mist is applied in an optimum location on the train of rollers in a lithographic printing system.

It is yet another object of the present invention to provide a dampening fluid mist application system which can be easily adapted to new printing systems or retrofitted into existing printing systems.

SUMMARY OF THE INVENTION

The above and other objects which will be apparent to those skilled in the art are achieved in the present invention which provides a liquid mist application system which includes a container for the liquid and a rotatable first roller having a rough surface for picking up and entrapping liquid from the container. A rotatable second roller having a brush surface contacts the first roller to transfer liquid from the surface of the first roller to bristles on the brush surface. A deflector bends and releases the bristles to eject liquid thereon and create a mist stream of the liquid.

Preferably, the axis of the second roller is disposed at a height above the top surface of the first roller in an approximately vertical orientation. The rough surface on the second roller is employed to provide the desired amount of dampening fluid to the bristles and may be made of wire mesh or a series of spaced projections or knobs, for example. The deflector can be made up of a plurality of separate blade segments whose edges contact different brush segments along the full width of the second roller. An adjustment mechanism can independently move the separate blade segments toward and away from the second roller by a coarse adjustment between bristle engaging and disengaging positions, and by a fine adjustment in the bristle engaging position to vary the degree of bending of the bristles between a minimum and a maximum.

The dampening fluid application system is suitable for incorporation into new printing systems or retrofitting into existing printing systems to apply the dampening fluid mist stream to the region between rollers in the train of ink transfer rollers.

BRIEF DESCRIPTION OF THE DRAWINGS

FIG. 5 is a sectional view along the line 5—5 of FIG. 2.

FIG. 6 is an enlarged sectional view between the brush roller and the rough roller shown in FIG. 5.

DETAILED DESCRIPTION OF THE INVENTION

Figure 1:
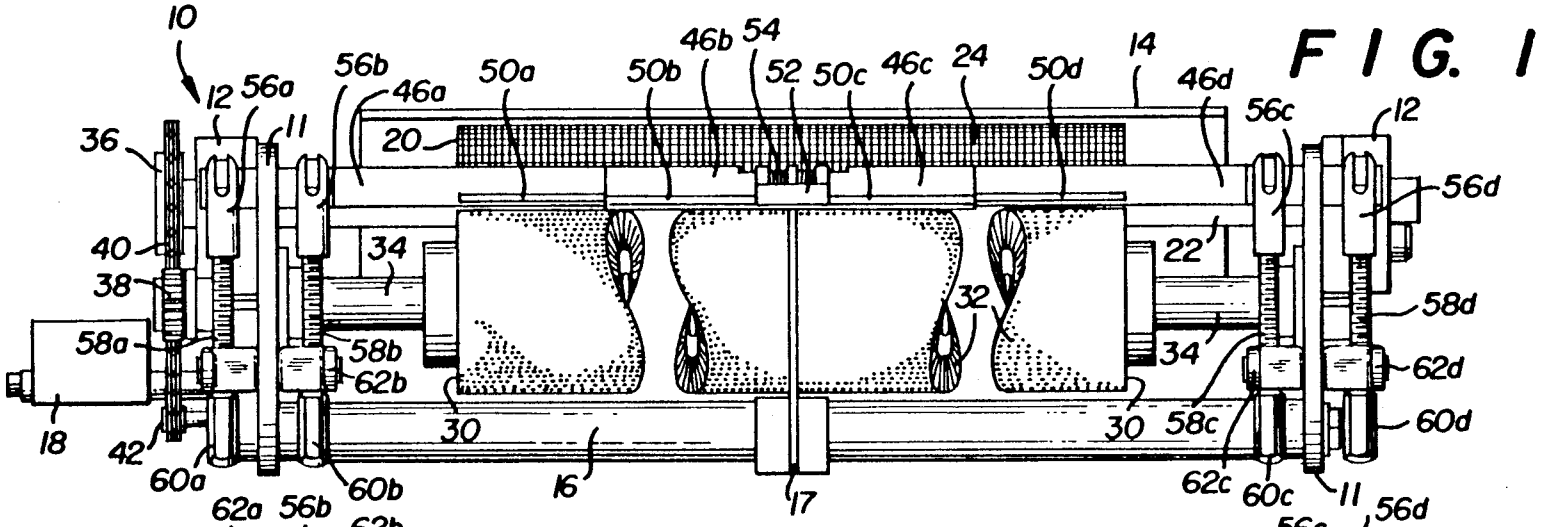
FIG. 1 is a top plan view, partially cut away, showing the preferred dampening fluid mist application system of the present invention.
Figure 2:
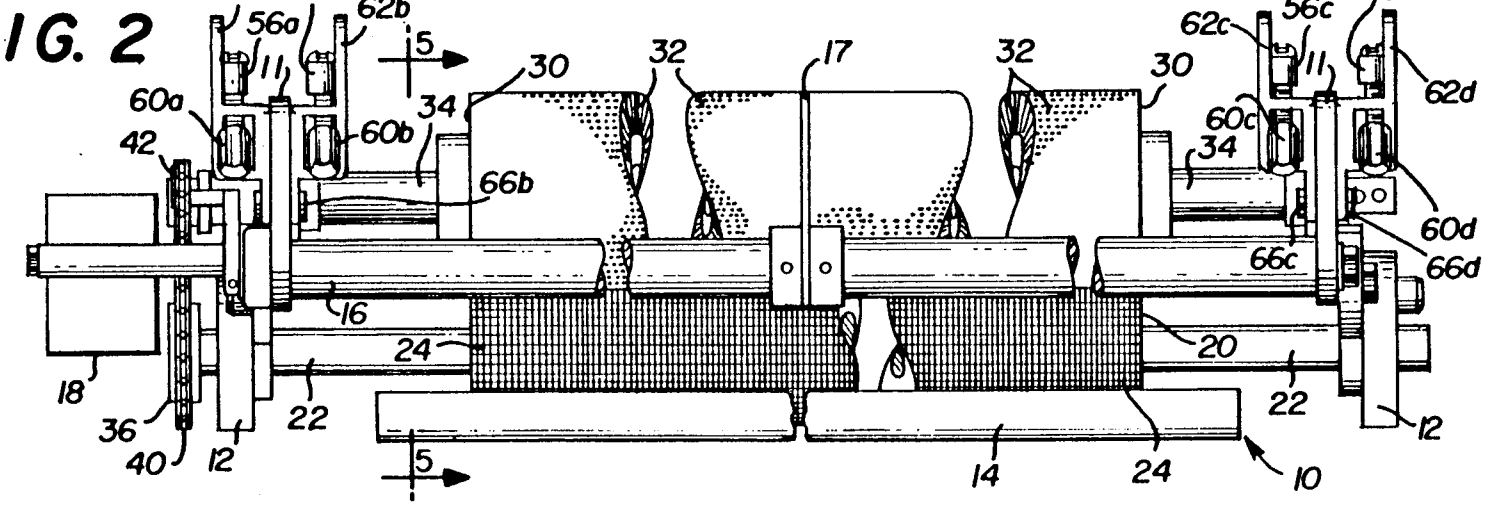
FIG. 2 is a side elevational view, partially cut away, of the system of FIG. 1.

In describing the present invention, reference will be made to FIGS. 1 through 7 in which like numerals refer to like features of the invention.

The preferred embodiment of the invention is depicted in detail in FIGS. 1 through 5 in top, side, end and cross sectional views. The dampening fluid application system 10 includes a tray or reservoir 14 for the dampening fluid (also known as a dampening fluid fountain) and a frame 12 on which the remaining components of the system are mounted. Dampening fluid 28 comprises any typical water based or other liquid solutions useful in lithographic printing systems. As the fluid 28 is used up, any standard replenishing apparatus (not shown) may be utilized to maintain a desired level of fluid in reservoir 14.

Member 16 extends between a pair of end plates 11 which are pivotally mounted to frame 12 by bolts 19. Also extending between end plates 11 are rotatable shafts 22 and 34, the axes of which are horizontal and parallel to one another. Mounted on shaft 22 is an approximately four (4) in. diameter cylindrical rough or raised surface roller 20, which is rotatable and partially immersed at its lower side in the dampening fluid in reservoir 14. The surface of roller 20 is preferably covered by a wire mesh 24 of screen material, for example. Any other raised or rough surface may be suitable, for example, a series of spaced projections or knobs. The purpose of this rough surface is to provide locations in which to pick up and entrap a desired amount of dampening fluid for subsequent transfer by providing interstices in which to hold liquid by capillary action or other means. By providing this rough, liquid-capturing surface, the roller may be driven at a relatively low speed, for example 50 rpm, which greatly diminishes wear of the system components.

Mounted above rough roller 20 and rotatable about shaft 34 is a cylindrical brush surface roller 30, the axis of which is above the uppermost point of roller 20 to achieve a generally vertical orientation of the two rollers. Brush roller 30 has an outer diameter approximately equal to that of rough surface roller 20. The two rollers are driven in opposite rotational directions as shown by the arrows in FIG. 5 so that the surfaces of each are moving in the same direction in the area of contact between the two. A structural member 17 extends from bar 16 to provide intermediate support to deflector shaft 46.

An electric motor (not shown) or other driving means may be mounted on motor mount 18 and directly coupled to brush roller shaft 34 to drive the apparatus. As best seen in the end views in FIG. 4, a chain drive system may be utilized to transfer power to the lower rough roller 20. The ends of roller shafts 22 and 34 are fitted with sprockets 36 and 38, respectively. A roller chain 40 extends around and between sprocket 36 and idler sprocket 42 and tangential to sprocket 38 in the manner shown to provide the proper angular direction of the respective rollers 20 and 30. While the sprocket diameters may be selected to provide any suitable speed ratios between rollers 20 and 30, it is preferred that the gearing be such that a 1:1 rotational speed ratio is maintained between the rollers. With the essentially equal diameters of the rollers, this will result in an essentially equal surface speed at the region of contact between the two rollers 20 and 30. Alternatively, the motor driving means may drive the rough surface roller or may drive the apparatus in any other suitable arrangement.

Figure 3:
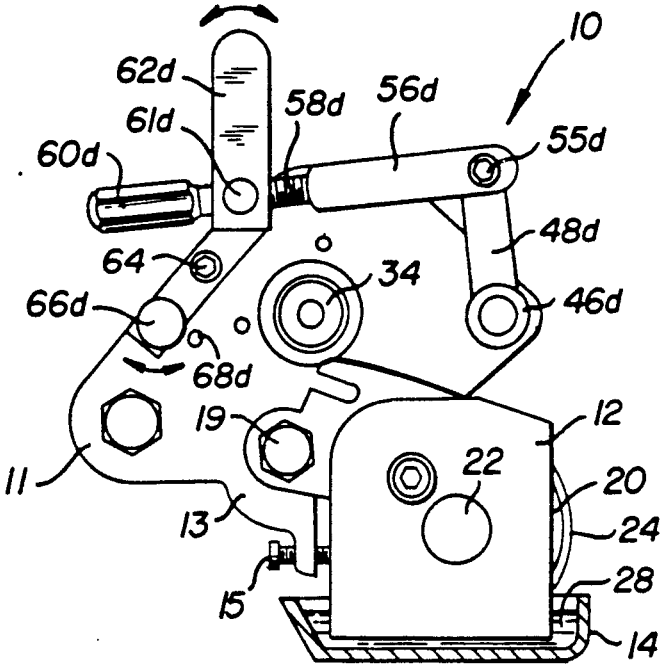
FIG. 3 is an end elevational view of the system in FIG. 1.
Figure 4:
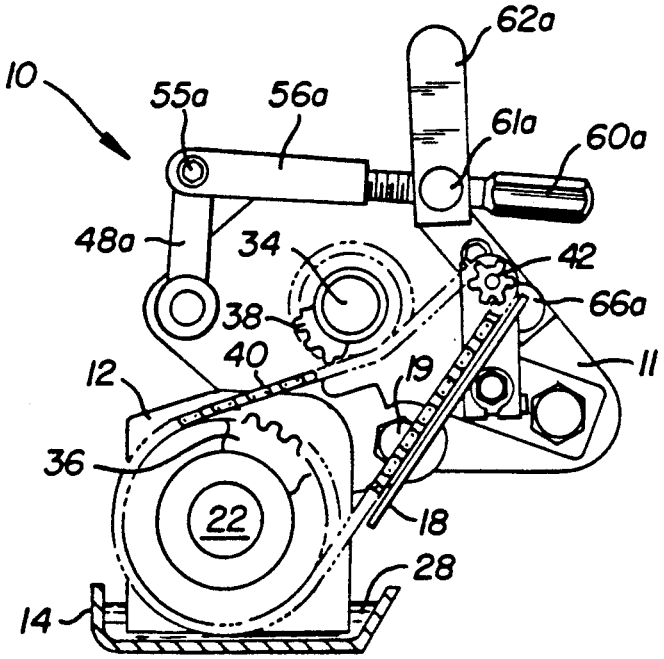
FIG. 4 is an elevational view, partially cut away, of the end opposite the end in FIG. 3.

The chain drive system depicted in the figures further provides that the spacing between the roller shafts 22 and 34 may be adjusted without changing the angular speed ratios between the rollers. As shown in FIG. 3, an extension 13 below side plate 11 includes a hole in which is threaded an adjusting screw 15 which bears against a side of frame 12. As screw 15 is turned, end plate 11 pivots around bolt 19 in relation to frame 12 to vary the distance between shafts 22 and 34. The distance between the roller shafts 22 and 34 may be adjusted to account for wear of the brush roller or other components, or to control the amount of liquid transferred between the rough surface rollers 20 and brush surface roller 30, as will be discussed in more detail below.

As shown most clearly in FIG. 5, brush surface roller 30 has a surface uniformly covered with closely spaced radial extending bristles 32 of suitable length and construction to pick up the dampening fluid upon moving contact with the surface of roller 20. A suitable brush surface may be 0.014 in. nylon bristles, for example, and should permit liquid to be trapped on and in the spaces between the individual bristles 32.

To deflect and release the bristles 32 on roller 30, there is provided a deflector bar 50 which comprises an elongated blade whose edge is in contact with the surface of brush roller 30. As seen in the top plan view of FIG. 1, deflector 50 extends parallel to and across the full width of brush roller 30 and is made up of continuous individual segments, each independently attached to and controlled by rotational movement of different segments of deflector shaft 46 to provide full mist control across the uniform bristle covered surface of roller 30. Deflector blade segment **50*a*, mounted on deflector shaft 46*a*, deflects those bristles at the extreme left side of brush roller 30, while deflector blade segment 50*b*, mounted on deflector shaft segment 46*b*, deflects those bristles in the left center portion of roller 30. Likewise, deflector blade segment 50*c*, mounted on deflector shaft segment 46*c*, controls the deflection at the right center portion of brush roller 30, while deflector blade segment 50*d*, mounted on deflector shaft segment 46*d*, controls the deflection at the extreme right end of roller 30. A spring loaded deflector blade flap portion 52 overlaps the small gap between deflector segments 50*b* and 50*c* at member 17, and is urged by spring 54 away from engagement with bristles 32. Movement of one or the other adjacent deflector segments 46*b* or 46*c* moves the flap 52** against the bristles.

To control the relative position of the deflector blade 50 segments against the bristles of brush roller 30, there is provided an adjustment mechanism which permits both coarse and a fine adjustment. A side view of the adjustment mechanism for deflector shaft segment **46*b* and deflector blade segment 50*b* is shown in FIG. 3. Secured to the end of deflector shaft segment 46*d* is an upstanding arm 48*d*, the upper end of which is pivotally connected by bolt 55*d* to fine adjustment member 56*d*. A threaded portion 58*d* extends longitudinally between fine adjustment knob 60*d* and member 56*d*. Knob 60*d* is rotatably secured in stationary handle 62*d* by fine adjustment pivot 61*d* and may be turned to lengthen or shorten the distance between pivots 55*d* and 61*d*, thereby rotating arm 48*d* and deflector shaft segment 46*d* to adjust the position of deflector blade segment 50*d* relative to the surface of the brush roller 30. As a coarse adjustment to move the deflector blade segment 50*d* between completely engaged and completely disengaged positions, the lower end of adjustment handle 62*d* includes a spring loaded coarse adjustment knob 66*d* which is normally locked in a corresponding hole in the side of frame 12. As shown in FIG. 3, the position of coarse adjustment handle 62*d* places the deflector shaft 46*d* and associated deflector blade 50*d* (not shown) in the disengaged position relative to the brush surface roller. Upon pulling knob 66*d* to disengage it from the hole, the entire handle 62*d* may be rotated in a counterclockwise direction around pivot 64 to engage coarse adjustment knob 66*d* into hole 68*d* in the side of frame 11, thereby shifting members 60*d*, 58*d* and 56*d* to rotate deflector shaft segment 46*d* and deflector blade 50*d* into engagement with the brush roller bristles 32**.

Similar coarse and fine deflector blade adjustment mechanisms are depicted in FIGS. 1, 2, 4 and 5 for the other deflector blade segments wherein the same numerals are used except that the letters "a", "b", and "c" are used for those components corresponding to the other deflector blade segments **50*a*, 50*b*, and 50*c*, respectively. Thus, for each deflector blade segment, there is provided a coarse adjustment which either engages or disengages the particular blade segment from the corresponding portion of the brush roller 30. This may be useful, for example where less than full width paper is being run through the lithographic printing process, thereby obviating the need for dampening fluid application along the full width of the printing cylinder. Likewise, the fine adjustment for each of the segments permits a variation in the degree of bending of the bristles across the face of the brush roller 30** between a minimum and a maximum, thereby permitting control of the mist application along the width of the roller, as desired.

In the operation of the dampening fluid application system of the present invention, the lower side of rough surface roller 20 is rotated through a reservoir of dampening fluid 28 whereby the liquid is picked up and carried in the spaces or interstices between the raised surface portions of the roller. The preferred rough surface roller employs a mesh screen. An alternate embodiment is shown in the enlarged portion depicted in FIG. 6, wherein a rough surface roller has a series of uniform and closely spaced projections or knobs 26, between which is entrapped the liquid dampening fluid 28. As the rough surface of roller 20 contacts the bristles 32 on the surface of rotating roller 30, dampening fluid 28 is transferred to the bristles 32.

The distance between the axes of shafts 22 and 34 may be adjusted to account for wear, such as that to bristles 32, and to adjust the degree of contact between the bristles and the raised surface of roller 20. Preferably, there is a uniform degree of contact between the rough roller 20 and brush roller 30 across their entire widths. This may be achieved, for example by passing a feeler gauge blade between the two and checking for uniform resistance across the entire width of the rollers. It is believed that this degree of contact not only affects the amount of dampening fluid transferred between the rollers, but also results in the creation of a slight deflection or "flicking" action to the individual bristles 32 which serves to eject excess liquid and provide a more uniform distribution across the face of the brush roller prior to engagement with the deflector blade. Preferably, the surface speed of rollers 20 and 30 are approximately equal, thereby minimizing wear to each.

As the moving brush surface encounters the stationary deflector blade 50 segments, the individual bristles 32 are sequentially bent and released whereby the entrapped liquid is ejected as an atomized mist of fine droplets of dampening fluid. Preferably, the deflector blade 50 is located at or above the level of the axis of brush roller shaft 34 so that the mist may be directed in an upward direction away from roller 30. The fine adjustment knobs 60*a*, 60*b*, 60*c* and 60*d* may be adjusted to control the degree of deflection by the corresponding deflector blade segments across the full width of the brush roller 30, thereby allowing for application of the desired amount of mist to each portion across the width of the printing plate. Should the printing press run less than full width paper, for example half width paper, then the unneeded deflector blade segments can be disengaged from the brush roller bristles by throwing the appropriate coarse adjustment handle 62*a*, 62*b*, 62*c* and/or 62*d*.

Figure 7:
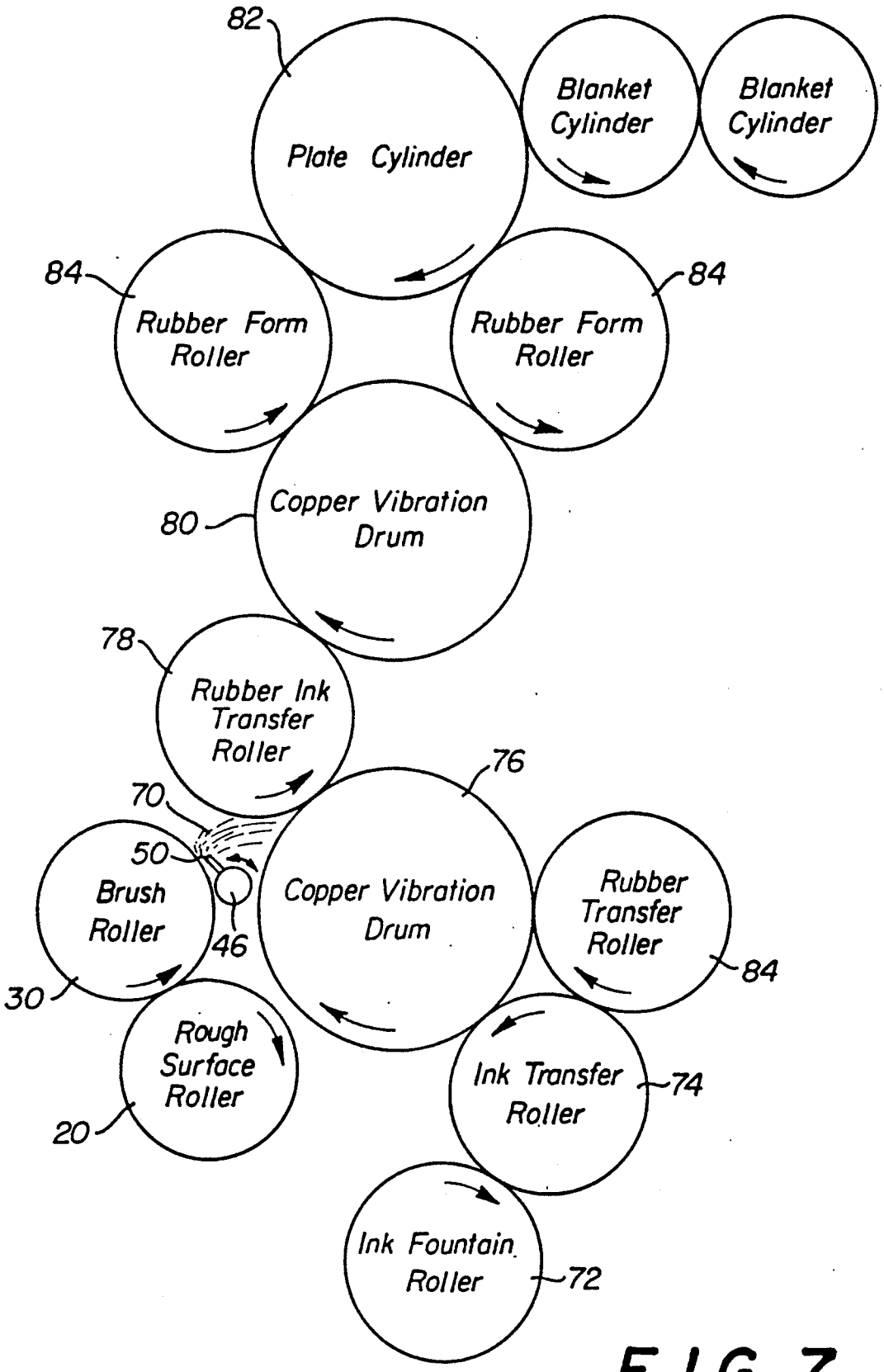
FIG. 7 is a schematic view of the mist application system of the present invention as installed in a typical lithographic printing system of transfer rollers.

The preferred location of the dampening application system in a typical lithographic printing apparatus is depicted in the end schematic view of FIG. 7. The lithographic printing roller train comprises, in contacting sequence, an ink fountain roller 72, a knurled ink fountain roller 74, a copper vibration drum 76, a rubber ink transfer roller 78, a copper drum 80 and the printing cylinder 82. Other lithographic printing apparatus may contain additional rollers 84 in the train. Preferably, the dampening fluid application system is disposed such that the dampening fluid 70 mist is applied to the region between the converging surfaces of a pair of rotating rollers, such as the region between the copper vibration drum 76 and the rubber ink transfer roller 78 as shown. Application of the mist on and in the region between and on two contacting rollers elsewhere in the train is also permissible. Such mist application permits the dampening solution to be evened out and distributed uniformly across the surfaces of the transfer roller train.

Thus, the present invention provides an improved dampening fluid mist application system which provides precise control of mist application across subsequent transfer rollers in the lithographic roller train. Furthermore, the structure of the system and location of the deflector bar permits preferred application on and in the region between converging roller surfaces and is easily incorporated into new systems or retrofitted into existing printing systems.

While the invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A liquid mist application system comprising:

a container for the liquid;

a rotatable first roller having a rough surface wherein the rough surface is a surface selected from the group consisting of a mesh surface and a surface with spaced knob projections, the roller for picking up and entrapping liquid from said container;

a rotatable second roller mounted above the first roller and having a brush surface uniformly covered with bristles and tangentially contacting the first roller, the contact surfaces of the two rollers moving in the same direction at the same speed for transferring liquid from the surface of said first roller to the bristles on said brush surface, the speed of said two rollers being about 50 rpm, the distance between said first and second rollers being adjustable to control the amount of transferred liquid; and a separate, adjustable deflector blade spaced apart from the first roller and extending across the width of the second roller for bending and releasing said bristles to eject liquid thereon and create a mist stream of said liquid, said deflector blade being made up of a plurality of separate, adjacent blade segments for contacting different brush segments along the width of said second roller, said separate blade segments being independently movable toward and away from the uniform surface of bristles of said second roller to vary the degree of bending of said bristles and control said mist stream across the width of said second roller.

2. The system of claim 1 wherein said deflector comprises an elongated blade having an edge for contacting said bristles, said elongated blade being rotatable about a longitudinal axis parallel to the second roller axis to move said blade edge toward and away from said second roller to vary the degree of bending of said bristles and control said mist stream.

3. The system of claim 1 wherein said deflector is adjustable by first coarse adjustment means to engage and disengage said deflector from contact with the bristles of said second roller and by a second independent fine adjustment means for varying degree of bending of said bristles between a minimum and a maximum.

4. The system of claim 1 further including means for varying the distance between axes of said rollers for adjusting the degree of contact between said first and second rollers.

5. A dampening fluid application system for lithographic printing comprising:

a reservoir for holding said dampening fluid;

a rotatable rough surface roller wherein the rough surface is a surface selected from the group consisting of a mesh surface and a surface with spaced knob projections, said roller immersible in said reservoir for picking up and entrapping said dampening fluid;

a rotatable brush surface roller tangentially contacting said rough surface roller for receiving fluid from said rough surface roller while the contact surfaces of said rollers move in the same direction at the same speed and transferring said fluid to bristles of the brush surface roller, the speed of said two rollers being about 50 rpm, the distance between said rough and brush surface rollers being adjustable to control the amount of transferred fluid; and a separate, adjustable deflector bar spaced apart from the rough surface roller and extending across the width of the brush surface roller roller for bending and releasing said bristles to eject liquid thereon and create a mist stream of said dampening fluid directable onto transfer rollers in a lithographic printing system, the deflector bar being adjustable by a first, coarse adjustment means to engage and disengage said deflector bar from contact with the bristles of said brush surface roller, said deflector bar being made up of a plurality of separate bar segments for contacting different brush segments along the width of said brush surface roller, said separate bar segments being independently adjustable by a second, fine adjustment means for movement toward and away from said brush surface roller to vary the degree of bending of said bristles and control said mist stream.

6. The application system of claim 5 wherein said rollers are rotatable about parallel, horizontal axes and wherein the axis of said brush surface roller is above said rough surface roller.

7. The application system of claim 6 wherein said deflector bar is parallel to said roller axes and disposed at or above the level of the brush surface roller axis.

8. The application system of claim 5 wherein said deflector bar comprises an elongated blade having an edge extending across the width of the brush surface roller for contacting said bristles, said deflector bar blade being movable toward and away from said brush surface roller to vary the degree of bending of said bristles to control said mist stream.

9. The application system of claim 6 further including means for varying the distance between axes of said rollers for adjusting the degree of contact between said rough surface and brush surface rollers.

10. A lithographic printing system comprising:

a train of a plurality of rotatable parallel cylindrical rollers in tangential contact for transferring an ink mixture to a printing cylinder; and the dampening fluid application system of claim 7, said dampening fluid application system disposed such that the dampening fluid mist stream is directed to apply said mist in the region between two of the rollers in said ink mixture transfer train.

11. The printing system of claim 10 wherein said rough surface roller has a surface of wire mesh.

12. The printing system of claim 10 wherein said rough surface roller has a surface composed of a series of spaced projections.

* * * * *